US005959398A

United States Patent [19]

Snijkers et al.

[11] Patent Number: 5,959,398

[45] Date of Patent: Sep. 28, 1999

[54] CATHODE RAY TUBE WITH IMPROVED CATHODE STRUCTURE

[75] Inventors: Franciscus M. M. Snijkers; Paul J. Van Rijswijck; Albert Manenschijn; René C. B. Weenink, all of Eindhoven, Netherlands

[73] Assignee: U.S. Philips Corporation, New York, N.Y.

[21] Appl. No.: 08/798,193

[22] Filed: Dec. 9, 1996

[30] Foreign Application Priority Data

Dec. 11, 1995 [EP] European Pat. Off. ..... 95203440

[51] Int. Cl.[6] ..... H01J 29/46; H01J 1/14; H01J 19/06; H01J 19/08

[52] U.S. Cl. ..... 313/446; 313/346 R; 313/340; 313/341; 313/344

[58] Field of Search ..... 313/409–411, 446, 313/450–51, 456, 346 R, 492, 631, 337, 341–42, 344, 270–71

[56] References Cited

U.S. PATENT DOCUMENTS 5,729,082 3/1998 Snijkers ..... 313/346 R

OTHER PUBLICATIONS

"Quick–Vision CTV Picture Tube A66–410X", by L.J.G. Beriere and A.J. van Ijzxeren (Philips Product Note, 1973).

*Primary Examiner*—Thomas M. Sember
*Assistant Examiner*—Mack Haynes
*Attorney, Agent, or Firm*—Robert J. Kraus

[57] ABSTRACT

A cathode ray tube is provided with an electron gun which comprises a cathode structure which contains an electron-emitting material at an end portion and in which a heating element of bifilarly wound wire is accommodated. Except in the vicinity of the ends of the wire, said wire is provided with an electrically insulating layer (46) whose radius decreases, near the transition between the covered wire and the uncovered ends, by at least 15%, preferably at least 30%. Preferably, the layer (46) having the reduced radius continues for at least 100 $\mu$m in the direction of the transition (54). The distance between the transition (54) and the electric connection (61) is smaller than 250 $\mu$m, preferably smaller than 150 $\mu$m. As a result, the number of uncovered turns between the electric connection (61) and the transition (54) is reduced to below five.

7 Claims, 3 Drawing Sheets

CATHODE RAY TUBE WITH IMPROVED CATHODE STRUCTURE

BACKGROUND OF THE INVENTION

The invention relates to a cathode ray tube having an electron source, which comprises a cathode structure which contains an electron-emitting material at an end portion and in which a heating element of bifilarly wound wire having primary and secondary turns is accommodated, said wire being provided, except in the vicinity of the ends of the wire facing away from the end portion, with an electrically insulating layer having a radius r, and said uncovered ends each being connected to an electric conductor by means of an electric connection.

The invention further relates to a heating element for use in a cathode structure of an electron source in a cathode ray tube.

Cathode ray tubes in which cathode structures comprising heating elements are used in electron sources are, for example, (flat-panel) display devices for displaying monochromatic or color images, camera tubes and oscilloscope tubes. Examples of electron sources are so-called impregnated cathodes or so-called oxide cathodes.

A cathode structure of the type mentioned in the opening paragraph is known from the brochure "Quick-Vision CTV Picture Tube A66-410X" by L. J. G. Berière and A. J. van IJzeren (Philips Product Note, 1973). In this brochure, a description is given of a tubular cathode structure in an electron gun for use in a cathode ray tube, having a layer of an electron-emitting material at an end portion to emit electrons. A heating element which serves to heat the electron-emitting material is arranged in the cathode structure. Said heating element comprises a wire which is bifilarly wound in the form of a double helix and which has primary and secondary turns. Said wire is provided with an electrically insulating layer.

Under specific conditions, the life of the cathode ray tube is governed by the life of the heating element. This applies in particular to cathodes which are operated at relatively high temperatures and in which, simultaneously, a low power is dissipated (for example in low-power impregnated cathodes).

SUMMARY OF THE INVENTION

It is an object of the invention to provide a cathode ray tube having a longer service life.

To this end, a cathode ray tube in accordance with the invention is characterized in that transitions are formed between the covered wire and the uncovered ends, and the radius r of the layer decreases by at least 15% near the transitions, the distance between the beginning of the decrease and the transitions being at least 100 $\mu$m.

The invention is based on the insight that, in particular, areas around the transitions between the covered wire and the uncovered ends in the heating element of the cathode structure have an important influence on the service life of the heating element. In the heating element in the known cathode structure, there is a(n) (abrupt) transition from a (primarily wound) wire which is provided with a layer to a (primarily wound) end which is uncovered, said uncovered end being connected to an electric conductor by means of an electric connection. The properties of the uncovered end influence the mechanical stability of the wire and hence the mechanical stability of the heating element. By reducing the radius of the layer by at least 15% near the transitions between the covered wire and the uncovered ends, the distance between the electric connection and the transition between the covered wire and the uncovered end can be reduced, resulting in an improved mechanical stability of the wire. An electrically insulating layer which continues up to a short distance from the electric conductor causes a reduction of the thermal efficiency of the heating element, yet said decrease in thermal efficiency is limited by the profile of the layer. The improvement of the mechanical stability of the wire leads to a longer (average) service life of the cathode structure and, under specific conditions, to a longer service life of the cathode ray tube.

An embodiment of the cathode ray tube in accordance with the invention is characterized in that the radius r of the layer decreases by at least 30%.

If, instead of an abrupt transition, the radius r of the electrically insulating layer decreases by at least 30%, the distance between the beginning of the decrease and the transitions between the covered wire and the uncovered ends being at least 100 $\mu$m, the distance between the electric connection and the transition between the covered wire and the uncovered end can be reduced further, which results in a further improvement of the mechanical stability of the wire. The improvement of the mechanical stability of the wire leads to a longer (average) service life of the heating element and, under specific conditions, to a longer service life of the cathode ray tube.

A further embodiment of the cathode ray tube in accordance with the invention is characterized in that the decrease of the radius r of the layer takes place at a distance of at least 100 $\mu$m from the transitions, resulting in the formation of a layer having a reduced radius which continues for at least 100 $\mu$m in the direction of the transitions.

The use of a layer whose radius decreases near the transitions between the covered wire and the uncovered ends, whereafter said layer having a reduced radius continues in the direction of the transitions, enables the part of the wire which is covered to be extended, so that the length of the uncovered ends decreases and hence the number of uncovered turns, which results in an improved mechanical stability of the wire, leading to a longer (average) service life of the cathode structure and, therefore, under specific conditions, to a longer (average) service life of the cathode ray tube.

A preferred embodiment of the cathode ray tube in accordance with the invention is characterized in that the distance between the transitions and the electric connection is less than 250 $\mu$m.

To heat the electron-emitting material, each uncovered end of the wire in the heating element must be provided with an electric conductor for applying a voltage during operation. The electric conductor is connected, for example, by means of a (welded) joint to the (uncovered) ends of the wire. To form a(n) (optimal) connection between the electric conductor and the uncovered end during the manufacture of the heating elements, it is desirable, at a specific radius r of the electrically insulating layer on the wire, to observe a minimum distance s between the electric connection and the transition between the covered wire and the uncovered end. The distance s between the electric connection and the transition between the covered wire and the uncovered end can be reduced considerably by reducing the radius r of the layer in the vicinity of the transitions between the covered wire and the uncovered ends. The reduction of the distance s leads to a reduction of the number of uncovered turns between the electric connection and the transition, so that the mechanical stability of the wire is improved, which leads to a longer (average) service life of the cathode structure and, under specific conditions, to a longer service life of the cathode ray tube.

A further embodiment of the cathode ray tube in accordance with the invention is characterized in that the distance between the transitions and the electric connection is less than 150 $\mu$m.

If the distance s is less than 150 $\mu$m, the number of uncovered turns between the electric connection and the transition decreases further, which results in an improvement of the mechanical stability of the wire. If the distance s is 150 $\mu$m, the number of uncovered primary turns is generally smaller than 5.

These and other aspects of the invention will be apparent from and elucidated with reference to the embodiments described hereinafter.

The Figures are purely schematic and not drawn to scale. In particular for clarity, some dimensions have been exaggerated strongly.

DESCRIPTION OF THE PREFERRED EMBODIMENTS

Figure 1A:
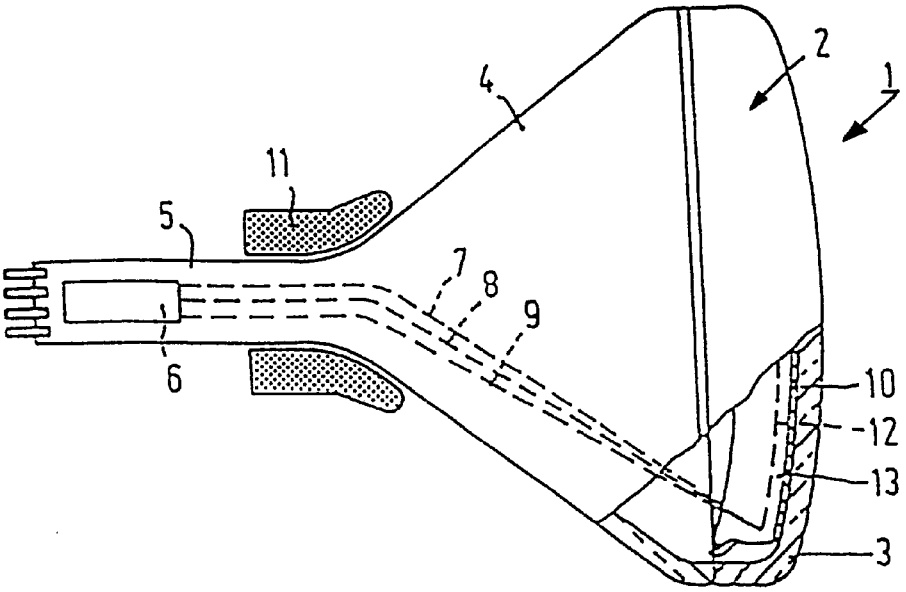
FIG. 1A PRIOR ART
FIG. 1A is a schematic, cross-sectional view of a cathode ray tube.

FIG. 1A is a schematic, cross-sectional view of a cathode ray tube 1 comprising an evacuated envelope 2 having a display window 3, a cone portion 4 and a neck 5. In the neck 5 there is arranged an electron gun 6 for generating three electron beams 7, 8 and 9. A display screen 10 is situated on the inside of the display window. Said display window 10 comprises a pattern of phosphor elements luminescing in red, green and blue. On their way to the display screen 10, the electron beams 7, 8 and 9 are deflected across the display screen 10 by means of deflection unit 11 and pass through a shadow mask 12, which comprises a thin plate having apertures 13, and which is arranged in front of the display window 3. The three electron beams 7, 8 and 9 pass through the apertures 13 of the shadow mask 12 at a small angle with respect to each other and, consequently, each electron beam impinges on phosphor elements of only one color.

Figure 1B:
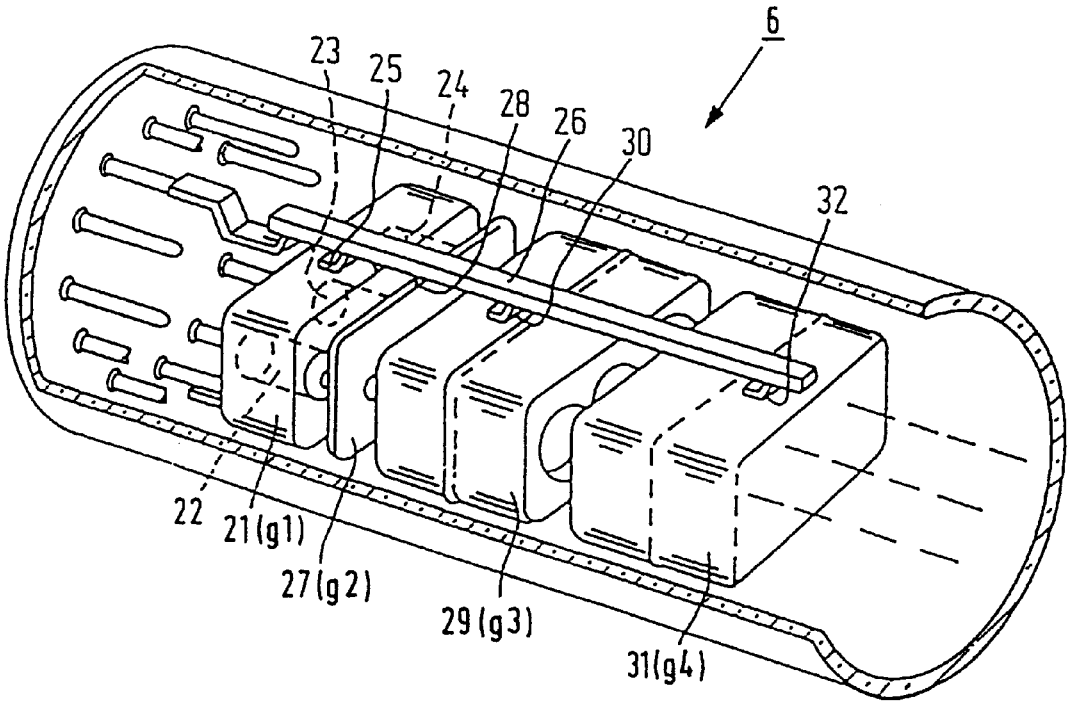
FIG. 1B PRIOR ART
FIG. 1B is a partly perspective view of an electron gun.

FIG. 1B is a partly perspective view of an electron gun 6. Said electron gun 6 has a common control electrode 21, also referred to as $g_1$ electrode, in which three cathode structures 22, 23 and 24 are secured. Said $g_1$ electrode is secured to supports 26 by means of connecting elements 25. Said supports are made of glass. The electron gun 6 further comprises, in this example, a common plate-shaped electrode 27, also referred to as $g_2$ electrode, which is secured to the supports 26 by connecting elements 28. In this example, said electron gun 6 comprises two supports 26. One of said supports is shown, the other is situated on the side of the electron gun 6 which is invisible in this perspective view. The electron gun 6 further includes the common electrodes 29 ($g_3$) and 31 ($g_4$), which are also secured to supports 26 by means of connecting elements 30 and 32.

Figure 2:
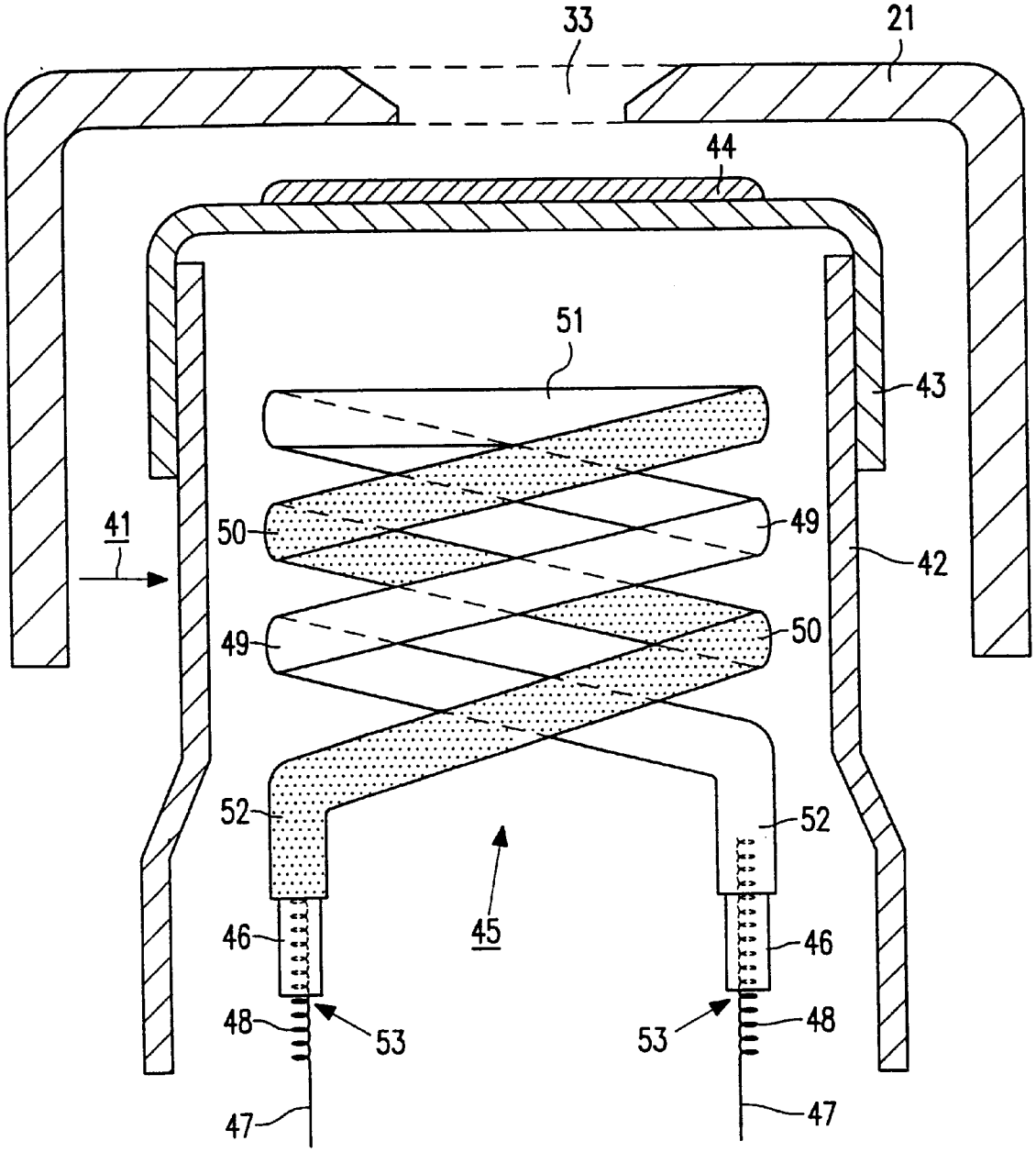
FIG. 2 PRIOR ART
FIG. 2 is a partly cross-sectional view of a state-of-the-art cathode structure.

FIG. 2 is a schematic, partly cross-sectional view of a cathode structure in accordance with the prior art. This cathode structure is provided with an end portion 41 and comprises a cathode shaft 42, which is sealed by a cap 43, which is partly covered with an electron-emitting material 44. Said cap 43 and the part of the cathode structure cooperating with said cap form, in this embodiment, the end portion 41 of the cathode structure. A heating element 45, which is used to heat the electron-emitting material 44, is provided in the cathode shaft 42. Said heating element 45 comprises a wire 47 which is bifilarly wound in the form of a double helix, said wire having primary turns 48 and secondary turns 49, 50 and is covered with an electrically insulating layer 46. The secondary turns are composed of a first series of turns 49, having a first direction of winding and extending with a pitch to the end portion 41, and of a second series of turns 50, extending from said end portion 41 and having the same direction of winding yet a pitch of opposite sign. The first and second series of secondary turns 49, 50 are interconnected near the end portion 41 of the cathode structure by a connecting portion 51 having primary turns 48. A number of electrodes, one of which is shown in FIG. 2, are situated above the cathode structure. The electrode 21 shown in FIG. 2 is the $g_1$ electrode having an aperture 33.

The electrically insulating layer 46 consists of at least one layer and may comprise various, predominantly inorganic materials, such as aluminium oxide ($Al_2O_3$). Said electrically insulating layer 46 may for example be composed of two or more layers having different densities and/or different compositions. Except in the vicinity of the ends, the electrically insulating layer 46 is provided with an outer (dark) layer 52, which promotes the heat radiation of the heating element 45 in the cathode shaft 42. A transition 53 is formed between the covered wire and the uncovered ends.

Figure 3C:
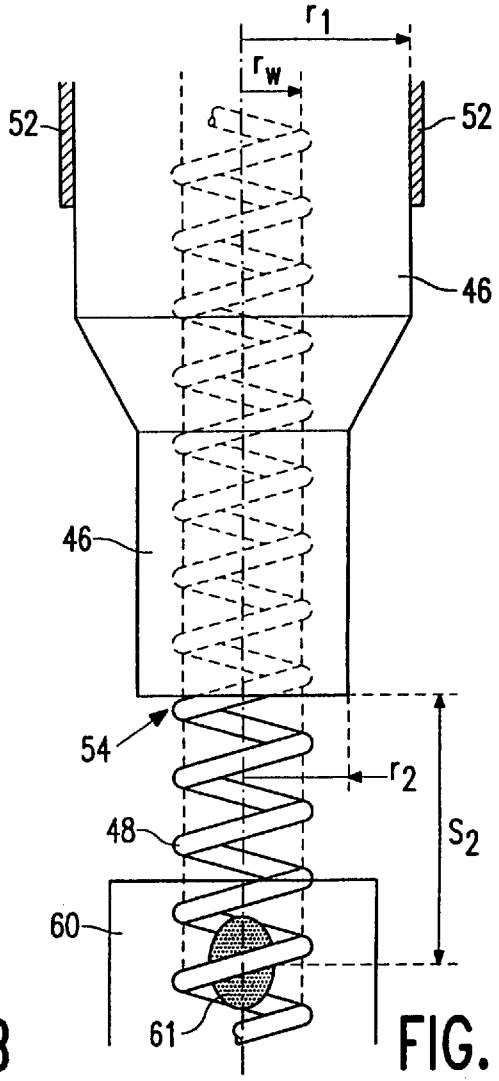
FIG. 3C is a partly cross-sectional view of the area around the transitions between the covered wire and the uncovered ends in accordance with the invention.
Figure 3B:
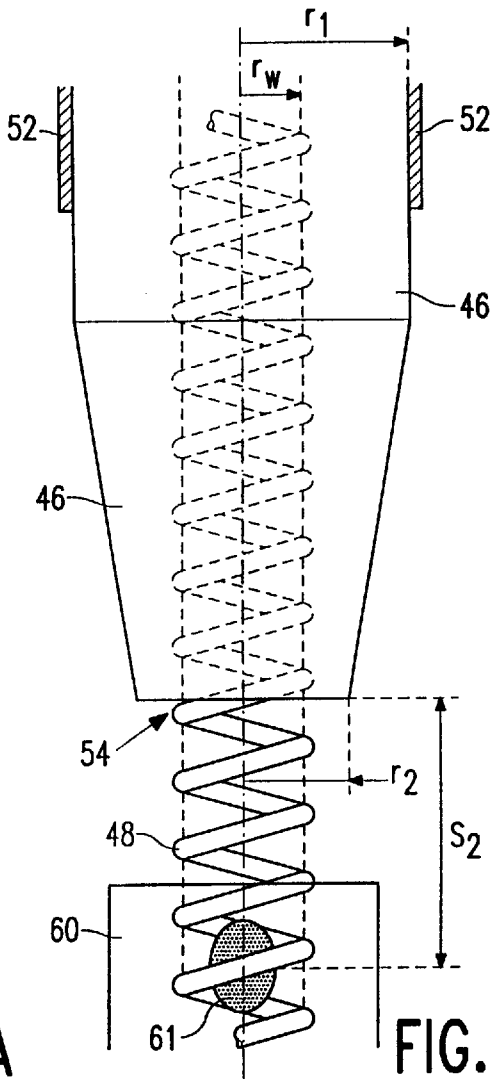
FIG. 3B is a partly cross-sectional view of the area around the transitions between the covered wire and the uncovered ends in accordance with the invention.
Figure 3A:
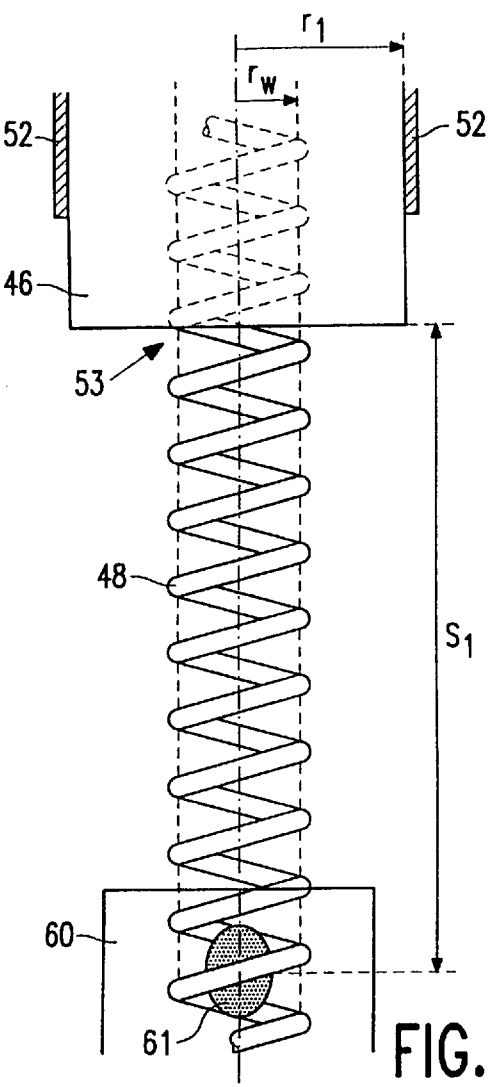
FIG. 3A PRIOR ART
FIG. 3A is a partly cross-sectional view of the area around the transitions between the covered wire and the uncovered ends in accordance with the prior art.

FIG. 3A is a partly cross-sectional view of the area around the transitions 53 between the (primary, wound) wire 48 having a radius $r_w$, which is provided with the electrically insulating layer 46, and the uncovered ends in accordance with the prior art. The electrically insulating layer 46 is partly provided with an outer (dark) layer 52. In this example, the uncovered end is connected to an electric conductor 60 via an electrical (welded) joint 61, which comprises, in this example, a number of primary turns 48 for bringing about a satisfactory electric connection. In the manufacture of the cathode structures, a connection between the electric conductor 60 and the uncovered end is formed, in which, at a specific radius $r_1$ of the layer 46, a minimum distance $s_1$ between the electric connection 61 and the transition 53 between the covered wire and the uncovered end is observed. In a reliable production process, the distance $s_1$ is preferably at least $4r_1$, so that, in this case, more than seven primary turns 48 are uncovered. The distance $s_1$ is preferably larger than the diameter ($=2r_1$) of the layer. In practice, this means that approximately 400 $\mu$m of the primary turns 48 between the electric connection 61 and the transition 53 are not provided with the electrically insulating layer 46. A reduction of the distance $s_1$ leads to a higher mechanical stability, however, this is difficult to achieve in the heating element in the known cathode structure.

FIGS. 3B and 3C show partly cross-sectional views of two embodiments of the area around the transitions 54 between the (primary, wound) wire 48 having a radius $r_w$, which is provided with the electrically insulating layer 46, and the uncovered ends, in accordance with the invention. The distance between the electric connection 61 and the transition 54 between the covered wire and the uncovered end can be reduced considerably by reducing the radius $r_1$ of the layer 46 to a radius $r_2$ near the transitions 54 between the covered wire and the uncovered ends.

In the exemplary embodiment of FIG. 3B, the radius of the layer 46 decreases gradually from $r_1$ to $r_2$ close to the transition 54, whereas in the exemplary embodiment of FIG. 3C, the radius of the layer first changes from $r_1$ to $r_2$ over a distance (of at least 100 $\mu$m), and then the radius of the layer 46 remains (substantially) constant up to the transition 54.

The electrically insulating layer 46 is preferably applied by means of cataphoresis. The change in layer thickness (from $r_1$ to $r_2$) of the electrically insulating layer 46 is obtained by causing the incandescent wire to make such a (physical) movement relative to the coating suspension, during the coating process, that the desired change in profile of the electrically insulating layer 46 is achieved. In an alternative embodiment of the coating process, a second suspension is used in addition to a first suspension.

With a view to connecting the electric conductor 60 to the uncovered end of the wire, the distance $S_2$ between the electric connection 61 and the transition 54 is smaller than 250 $\mu$m, preferably smaller than 150 $\mu$m, in the exemplary embodiments of FIGS. 3B and 3C. In this case, fewer than five, preferably only three, primary turns 48 remain uncovered. The reduction of the distance between the electric connection 61 and the transition 54 causes the number of uncovered turns between the electric connection 61 and the transition 54 to decrease, so that the mechanical stability of the wire improves, which in turn leads to a longer (average) service life of the cathode structure and, under specific conditions, of the cathode ray tube.

To obtain a good heat balance of the heating element 45, (physical) contact between the layer 46 and the electric conductor 60 should be avoided, so that heat transfer between the heating element 45 and the conductor 60 cannot take place. The profiled shape of the electrically insulating layer 46 causes the risk of physical contact between the layer 46 and the conductor 60 to be reduced considerably, and it allows the layer to be continued up to a small distance from the electrical (welded) joint 61. This leads to a reduction of the number of uncovered turns and to a considerable increase of the mechanical stability of the heating element.

When the cathode structure is energized, much more power is dissipated in the heating element 45 than in the equilibrium condition, because the resistance of the wire is temperature-dependent. The uncovered turns between the transition 54 and the electric connection 61 can only give up heat to their environment by means of radiation. As a result, shortly after energizing the cathode structure, the temperature in the uncovered turns becomes relatively high, which may lead to the so-called "flashing" of the turns 48. If layer 46 shown in FIG. 3B or 3C had not been provided with a profile, but had continued without a reduction of the radius (in a straight line) up to a short distance from the electrical connection 61, connection of the wire to the electric connection would have been hampered considerably, while the thermal losses of the heating element 45 would have increased considerably. The expression "thermal losses" is to be understood to mean herein the radiation of heat (through the surface) at the end of the layer, which is not absorbed by the cathode shaft 42. As a result of the reduction of the radius of the electrically insulating layer 46 near the transitions 54, on the one hand, the number of uncovered turns decreases, leading to an improvement of the mechanical stability of the heating element 45, while, on the other hand, the profile of the layer leads to only a limited thermal efficiency loss of the heating element 45.

In the exemplary embodiment of FIG. 3B, the radius of the primary turns $r_w$=80 $\mu$m, the thickness of the electrically insulating layer, which is covered with the (dark) layer, is 65 $\mu$m, which corresponds to a radius $r_w$=145 $\mu$m, the thickness of the electrically insulating layer which is not covered with the (dark) layer decreasing gradually to 35 $\mu$m, which corresponds to a radius $r_2$ =115 $\mu$m. In this case, the decrease of the radius of the electrically insulating layer is more than 20% and hence meets the requirements of the invention (decrease>15%), which corresponds to an increase of the thermal efficiency of the heating element 45 by more than 5° C.

In the exemplary embodiment of FIG. 3C, the radius of the primary turns $r_w$=80 $\mu$m, the thickness of the electrically insulating layer, which is covered with the (dark) layer, is 100 $\mu$m, which corresponds to a radius $r_w$=180 $\mu$m, the thickness of the electrically insulating layer which is not covered with the (dark) layer decreasing to 20 $\mu$m (corresponding to a radius $r_2$=100 $\mu$m) and, subsequently, remaining (substantially) constant up to the transition between the covered wire and the end. The decrease of the radius of the electrically insulating layer, in this example, is approximately 44%, so that it meets the requirements of the invention (decrease>15%). In addition, the value of the decrease lies in the preferred range (decrease>30%). A decrease of the thickness of the electrically insulating layer by 44% corresponds to an increase of the thermal efficiency of the heating element 45 by more than 15° C.

It will be obvious that, within the scope of the invention, many variations are possible to those skilled in the art. For example, the position of the outer (dark) layer can be varied relative to the part of the electrically insulating layer having a reduced radius, in order to bring about a thermal efficiency of the heating element which is as high as possible. In general, it is not very useful to allow the (dark) layer to continue (far) beyond the end of the cathode shaft facing away from the end portion.

In general, it is desirable to reduce the thickness of the electrically insulating layer near the end of the cathode shaft facing away from the end portion. Preferably, the distance over which the thickness of the electrically insulating layer should decrease relative to the end of the cathode shaft facing away from the end portion, is maximally 250 $\mu$m, the distance being measured in the direction of the end portion.

In general, the invention relates to a cathode ray tube comprising an electron gun having a cathode structure which contains an electron-emitting material at an end portion and in which a heating element of bifilarly wound wire is accommodated. Except in the vicinity of the ends, said wire is provided with an electrically insulating layer whose radius, near the transition between the covered wire and the uncovered ends, decreases by at least 15%, preferably at least 30%. Preferably, the layer having the reduced radius continues for at least 100 $\mu$m in the direction of the transitions. The distance between the transitions and the electric connection is less than 250 $\mu$m, preferably less than 150 $\mu$m. As a result, the number of uncovered turns between the electric connection and the transition is reduced to below five.

We claim:

1. A cathode ray tube having an electron source, which comprises a cathode structure which contains an electron-emitting material (44) at an end portion (41) and in which a heating element (45) of bifilarly wound wire (47) having primary turns (48) and secondary turns (49, 50) is accommodated, said wire (47) being provided, except in the vicinity of the ends of the wire (47) facing away from the end portion (41), with an electrically insulating layer (46) having a radius r, and said uncovered ends each being connected to an electric conductor (60) by means of an electric connection (61), characterized in that transitions (54) are formed between the covered wire and the uncovered ends, and the radius r of the layer (46) decreases by at least 15% near the transitions (54), the distance between the beginning of the decrease and the transitions (54) being at least 100 $\mu$m.

2. A cathode ray tube as claimed in claim 1, characterized in that the radius r of the layer (46) decreases by at least 30%.

3. A cathode ray tube as claimed in claim 1 or 2, characterized in that the decrease of the radius r of the layer (46) takes place at a distance of at least 100 $\mu$m from the transitions (54), resulting in the formation of a layer (46) having a reduced radius, which continues for at least 100 $\mu$m in the direction of the transitions (54).

4. A cathode ray tube as claimed in claim 1, 2 or 3, characterized in that the distance between the transitions (54) and the electric connection (61) is less than 250 $\mu$m.

5. A cathode ray tube as claimed in claim 4, characterized in that the distance between the transitions (54) and the electric connection (61) is less than 150 $\mu$m.

6. A cathode ray tube as claimed in any one of the preceding Claims, characterized in that the number of primary turns (48) between the electric connection (61) and the transition (54) is smaller than five.

7. A heating element (45) for use in a cathode structure of an electron gun in a cathode ray tube as claimed in any one of the preceding Claims.

* * * * *